US010487488B2

(12) United States Patent
Nagai

(10) Patent No.: US 10,487,488 B2
(45) Date of Patent: Nov. 26, 2019

(54) SANITARY WASHING DEVICE

(71) Applicant: AISIN SEIKI KABUSHIKI KAISHA, Kariya-shi (JP)

(72) Inventor: Koji Nagai, Kiyosu (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 0 days.

(21) Appl. No.: 15/892,717

(22) Filed: Feb. 9, 2018

(65) Prior Publication Data

US 2018/0230685 A1 Aug. 16, 2018

(30) Foreign Application Priority Data

Feb. 14, 2017 (JP) ..... 2017-024931

(51) Int. Cl.

| | |
|---|---|
| ***E03D 9/08*** | (2006.01) |
| ***B05B 1/34*** | (2006.01) |
| ***B05B 15/70*** | (2018.01) |
| ***B05B 12/34*** | (2018.01) |

(52) U.S. Cl.

CPC ..... *E03D 9/08* (2013.01); *B05B 1/3436* (2013.01); *B05B 15/70* (2018.02); *B05B 12/34* (2018.02)

(58) Field of Classification Search

CPC ..... E03D 9/08; B05B 12/34
USPC ..... 4/300.3
See application file for complete search history.

(56) References Cited

U.S. PATENT DOCUMENTS

2017/0067240 A1* 3/2017 Komatsu ..... E03D 9/08

FOREIGN PATENT DOCUMENTS

JP 5896171 3/2016

* cited by examiner

*Primary Examiner* — Tuan N Nguyen
(74) *Attorney, Agent, or Firm* — Oblon, McClelland, Maier & Neustadt, L.L.P.

(57) ABSTRACT

A sanitary washing device includes: a sprayer that jets a liquid to a surface of a toilet bowl portion of a toilet bowl; and a movable-type scattering suppression member that is movable between a closed position and an opened position and suppresses the liquid jetted from the sprayer from scattering to an upper surface side of the toilet bowl at the opened position.

11 Claims, 10 Drawing Sheets

SANITARY WASHING DEVICE

CROSS REFERENCE TO RELATED APPLICATIONS

This application is based on and claims priority under 35 U.S.C. § 119 to Japanese Patent Application 2017-024931, filed on Feb. 14, 2017, the entire contents of which are incorporated herein by reference.

TECHNICAL FIELD

This disclosure relates to a sanitary washing device attached to a toilet bowl.

BACKGROUND DISCUSSION

Conventionally, as a sanitary washing device of this type, there is known one that includes a human-body washing nozzle, which has a human-body local-region jetting hole from which water is jetted to wash a local region of the human body and a toilet bowl washing jetting hole from which water is jetted toward the surface of a bowl portion of a toilet bowl (see e.g., JP Patent No. 5896171 (Reference 1)). This sanitary washing device suppresses dirt from adhering to the surface of the bowl portion of the toilet bowl by jetting water toward the surface of the bowl portion of the toilet bowl from the toilet bowl washing jetting hole of the human-body washing nozzle before a user uses the toilet bowl.

In the conventional sanitary washing device, water may be jetted from the toilet bowl washing jetting hole of the human-body washing nozzle to the surface of the bowl portion of the toilet bowl in a state where the user sits on the toilet bowl. In this case, the water jetted from the toilet bowl washing jetting hole scatters as water droplets, thereby adhering to the hips or legs of the user, which may give the user discomfort.

Thus, a need exists for a sanitary washing device which is not susceptible to the drawback mentioned above.

SUMMARY

A sanitary washing device according to an aspect of this disclosure is a sanitary washing device including a sprayer that jets a liquid to a surface of a toilet bowl portion of a toilet bowl and a movable-type scattering suppression member that is movable between a closed position and an opened position and suppresses the liquid jetted from the sprayer from scattering to an upper surface side of the toilet bowl at the opened position.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Next, a mode for carrying out this disclosure will be described with reference to the drawings.

Figure 1:
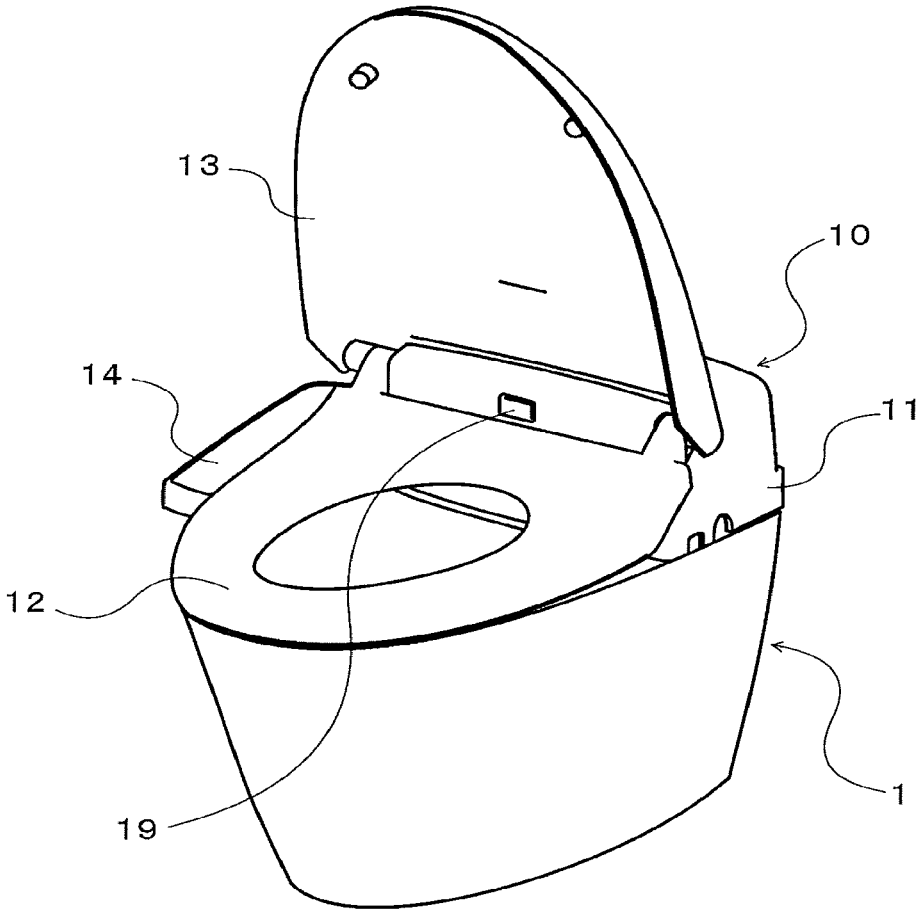
FIG. 1 is a perspective view illustrating a toilet bowl to which a sanitary washing device disclosed here is attached.

FIG. 1 is a perspective view illustrating a toilet bowl 1 to which a sanitary washing device 10 disclosed here is attached. The toilet bowl 1 illustrated in FIG. 1 is a western-style toilet bowl on which a user sits, and the sanitary washing device 10 is fixed to the upper surface of the toilet bowl 1. The sanitary washing device 10 includes a casing 11, a seat 12 rotatably supported by the casing 11, a lid 13 rotatably supported by the casing 11 in the same manner as the seat 12, and an operation panel 14.

Figure 2:
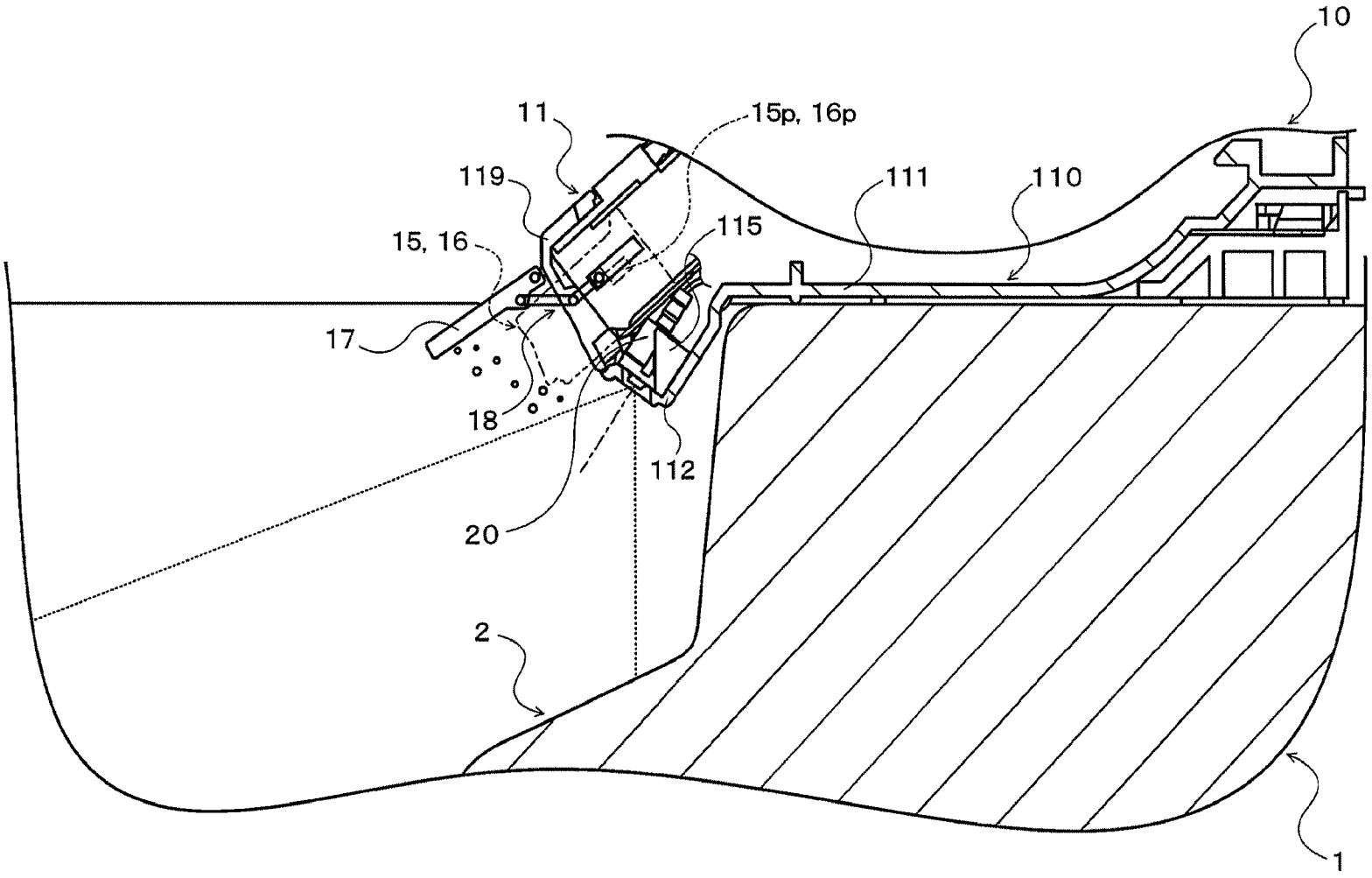
FIG. 2 is a partial cross-sectional view illustrating the toilet bowl to which the sanitary washing device disclosed here is attached.

The casing 11 of the sanitary washing device 10 includes a base plate (base member) 110, which is fixed to the upper surface of the toilet bowl 1 and is formed of a resin, and a cover 119, which is detachably attached to the base plate 110 and is formed of a resin. As illustrated in FIG. 2, the base plate 110 includes a flat portion 111 fixed to the upper surface of the toilet bowl 1 and an inclined portion 112 extending in an inclined manner from one end of the flat portion 111 toward a toilet bowl portion 2 of the toilet bowl 1. When the casing 11 (the base plate 110) is fixed to the toilet bowl 1, the inclined portion 112 enters the toilet bowl portion 2, as illustrated in FIG. 2.

Figure 3:
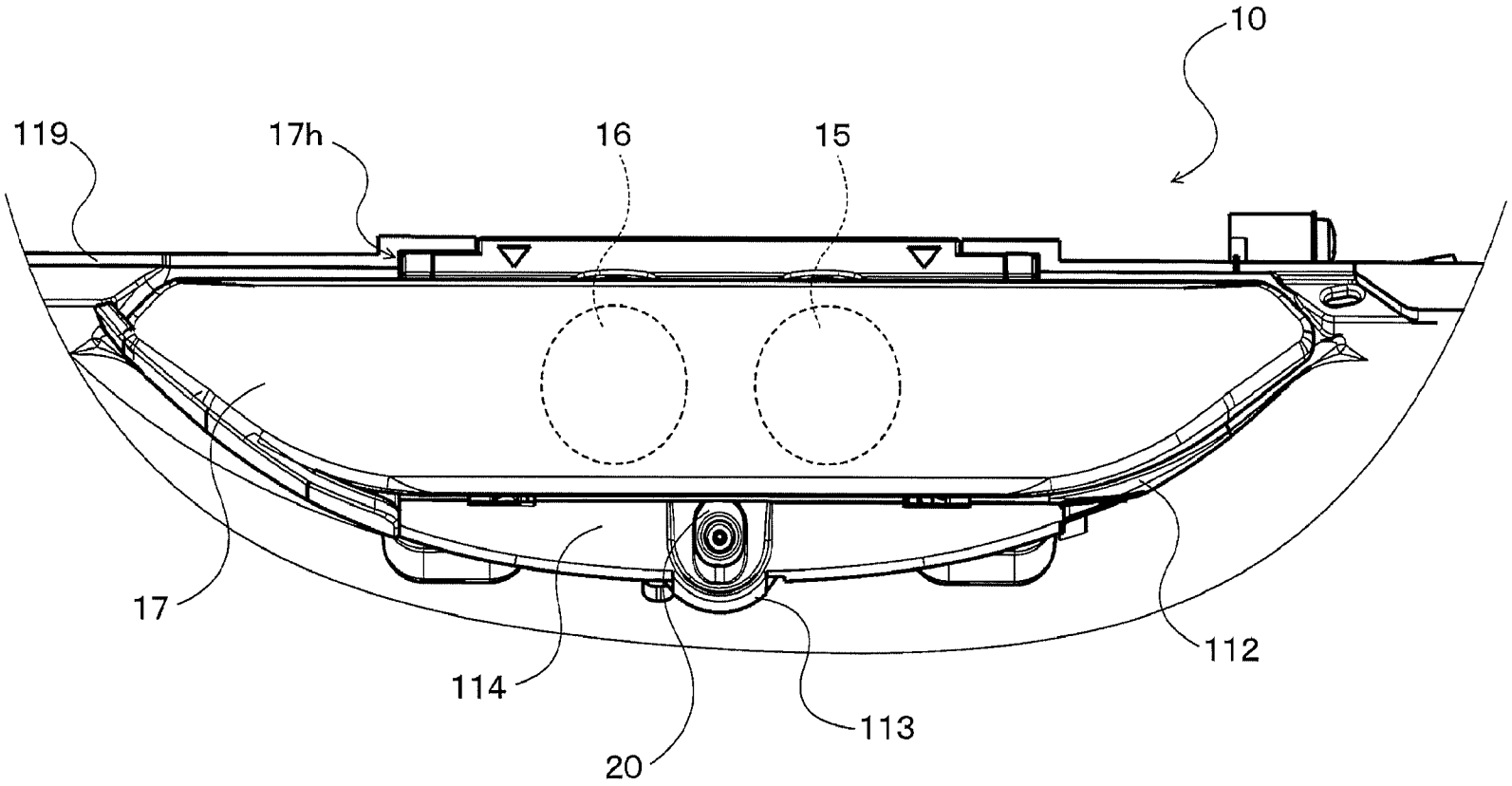
FIG. 3 is a front view illustrating the sanitary washing device disclosed here.
Figure 4:
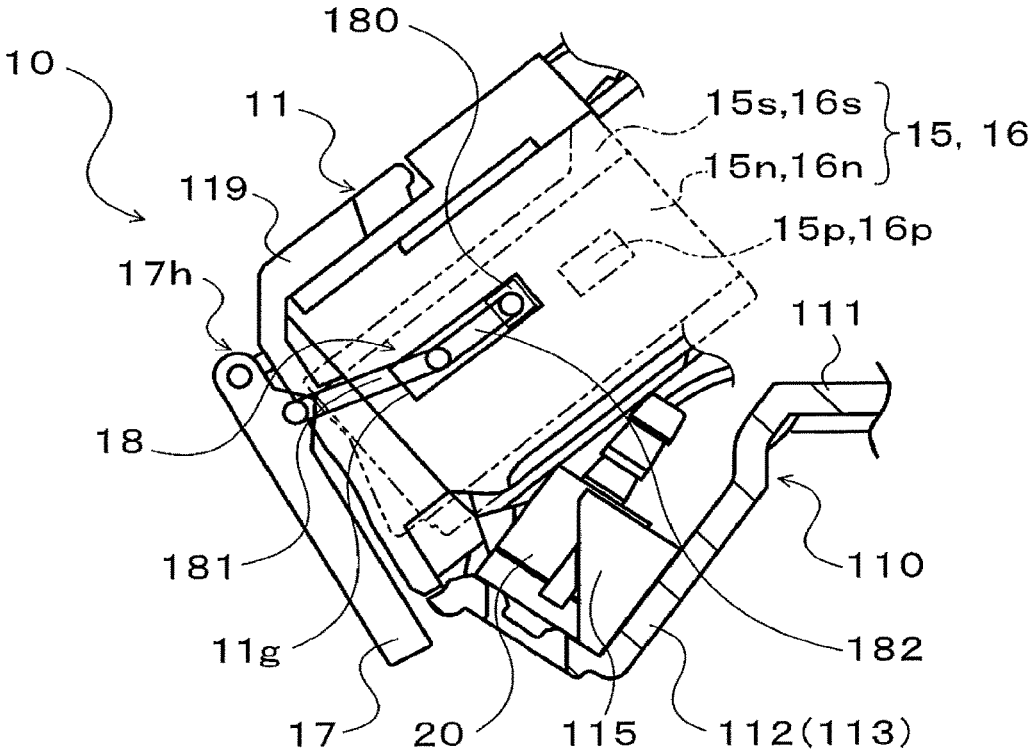
FIG. 4 is an enlarged view illustrating the major part of the sanitary washing device disclosed herein.
Figure 5:
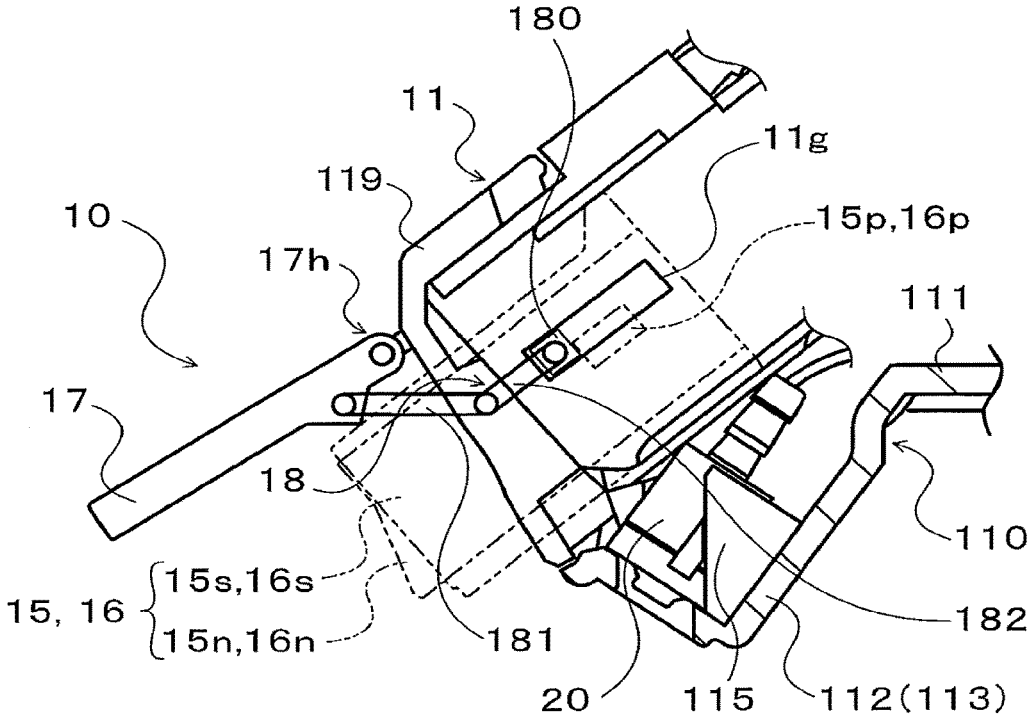
FIG. 5 is an enlarged view illustrating the major part of the sanitary washing device disclosed here.

Inside the casing 11 (the base plate 110 and the cover 119), as illustrated in FIG. 3, a hip washing nozzle 15 and a bidet nozzle 16, which are human-body washing nozzles, are disposed to jet water (including warm water) to local regions of the human body respectively. As illustrated in FIGS. 4 and 5, the hip washing nozzle 15 includes a nozzle body 15*n*, which is capable of moving back and forth relative to the casing 11, and a cylinder portion 15*s*, which accommodates the nozzle body 15*n* therein to be movable back and forth. The cylinder portion 15*s* is moved back and forth in the axial direction relative to the casing 11 within a predetermined range by an actuator (not illustrated), which includes, for example, a motor or a rack-and-pinion mechanism. In addition, the nozzle body 15*n* is moved back and forth in the axial direction between an accommodated position and a washing position on the toilet bowl portion 2 side by the pressure of water supplied to the hip washing nozzle 15 or by the biasing force of a spring (not illustrated).

The bidet nozzle 16 includes a nozzle body 16*n*, which is capable of moving back and forth relative to the casing 11, and a cylinder portion 16*s*, which accommodates the nozzle body 16*n* therein so as to be movable back and forth. The cylinder portion 16*s* is moved back and forth in the axial direction relative to the casing 11 within a predetermined range by the actuator. In addition, the nozzle body 16*n* is moved back and forth in the axial direction between an accommodated position and a washing position on the toilet bowl portion 2 side by the pressure of water supplied to the bidet nozzle 16 or the biasing force of a spring (not illustrated).

Moreover, for example, a valve unit that is connected to a tap water pipe (water source) via a branch faucet and a water supply hose, a water tank that is connected to the valve unit, and a rotary valve (water momentum adjustment switching valve) that connected to the hip washing nozzle 15, the bidet nozzle 16, and the water tank (all of which are not illustrated) are accommodated inside the casing 11. The valve unit includes, for example, a strainer, a check valve, a constant flow rate valve, a water stopping solenoid valve, and a relief valve. The water tank includes a heater, which heats water from the tap water pipe (water source), or a temperature sensor, and may store hot water heated by the heater. The rotary valve may selectively switch the supply destination of water from the water tank between the hip washing nozzle 15 and the bidet nozzle 16 and may adjust the amount of water to be supplied to the nozzles 15 and 16. At this time, the sanitary washing device 10 may be provided with a heat exchanger having a heating heater, instead of the water tank, so as to enable so-called instantaneous hot-water supply.

In addition, a control device (not illustrated) is accommodated inside the casing 11 to control the sanitary washing device 10. The control device controls, for example, the valve unit, the heater of the water tank, the actuator for the hip washing nozzle 15 and the bidet nozzle 16, and the rotary valve based on, for example, a signal from the operation panel 14, a seating sensor 19 (see FIG. 1), or the temperature sensor of the water tank.

As illustrated in FIGS. 2 and 3, a movable-type shutter (scattering suppression member) 17 is provided on the casing 11 of the sanitary washing device 10. As illustrated in FIG. 3, the shutter 17 is a substantially trapezoidal plate-shaped member having a width approximately equal to the width of an opening in the seat 12, and the upper end portion of the shutter 17 in FIG. 3 is rotatably supported by the cover 119 of the casing 11 via a hinge 17*h*. In addition, although the shutter 17 of the embodiment disclosed here is formed in a flat plate shape, the shutter 17 may have an arcuate cross-sectional shape. In addition, a spring (not illustrated) is interposed between the shutter 17 and the cover 119 of the casing 11, and the shutter 17 is urged to the closed position side illustrated in FIG. 4 by the spring. At the closed position, the shutter 17 covers the tip end portion of the hip washing nozzle 15 and the tip end portion of the bidet nozzle 16. Thus, it is possible to suppress contamination of the hip washing nozzle 15, the bidet nozzle 16, or the periphery thereof, or to maintain a pleasant aesthetic appearance by concealing both the nozzles.

Moreover, a link mechanism 18 as a motion conversion mechanism is connected to the shutter 17 to convert a linear motion of the cylinder portion 15*s* or 16*s* in the axial direction into a rotational motion of the shutter 17. The link mechanism 18 includes a slider 180, which is guided by a guide portion 11*g* formed on the casing 11 (the base plate 110 or the cover 119), a first link 181, which is pin-coupled to the shutter 17 at a position spaced apart from the hinge 17*h* to the free end side, and a second link 182, which is pin-coupled to the slider 180 and is also pin-coupled to the first link 181. In addition, a pressing portion 15*p* or 16*p* is provided on the outer peripheral surface of the cylinder portion 15*s* of the hip washing nozzle 15 and the cylinder portion 16*s* of the bidet nozzle 16 so as to be brought into contact with the slider 180 of the link mechanism 18.

As illustrated in FIG. 4, the pressing portions 15*p* and 16*p* of the cylinder portions 15*s* and 16*s* are spaced apart from the slider 180 of the link mechanism 18 when the shutter 17 is at the closed position and are not brought into contact with the slider 180. On the other hand, when one of the cylinder portions 15*s* and 16*s* of the hip washing nozzle 15 and the bidet nozzle 16 moves toward the toilet bowl portion 2, as illustrated in FIG. 5, the pressing portion 15*p* or 16*p* is brought into contact with the corresponding slider 180 of the link mechanism 18, thereby pressing the slider 180. The slider 180 is moved toward the shutter 17 by being pressed by the pressing portion 15*p* or 16*p*, and the first and second links 181 and 182 move so as to press the shutter 17 in conjunction with the movement of the slider 180. Thus, the shutter 17 rotates as if it jumps up about the hinge 17*h* against the biasing force of the spring.

The cylinder portion 15*s* or 16*s* stops at the timing when the slider 180 of the link mechanism 18 comes into contact with one end (the left end in FIG. 5) of the guide portion 11*g*, and the shutter 17 is maintained at the opened position as a portion thereof is supported by the stopped cylinder portion 15*s* or 16*s*. Thus, it is possible to move the nozzle body 15*n* of the hip washing nozzle 15 or the nozzle body 16*n* of the bidet nozzle 16 to the washing position on the toilet bowl portion 2 side. In addition, when the cylinder portion 15*s* or 16*s* moves toward the flat portion 111 side, the shutter 17 is not supported by the cylinder portion 15*s* or 16*s* and is urged by the spring (not illustrated) to thereby return to the closed position.

Moreover, the sanitary washing device 10 includes a sprayer 20, which jets water to the surface of the toilet bowl portion 2 of the toilet bowl 1. The sprayer 20 smoothens the surface of the toilet bowl portion 2 by spraying water thereto, thereby making it difficult for dirt to adhere to the toilet bowl portion 2, and also interposes a water film between dirt and the surface of the toilet bowl portion 2 so as to cause the dirt to be easily separated from the surface of the toilet bowl portion 2 upon toilet bowl washing. As illustrated, for example, in FIG. 2, the sprayer 20 is fixed to the above-described inclined portion 112 formed on the base plate 110 of the casing 11.

Figure 6:
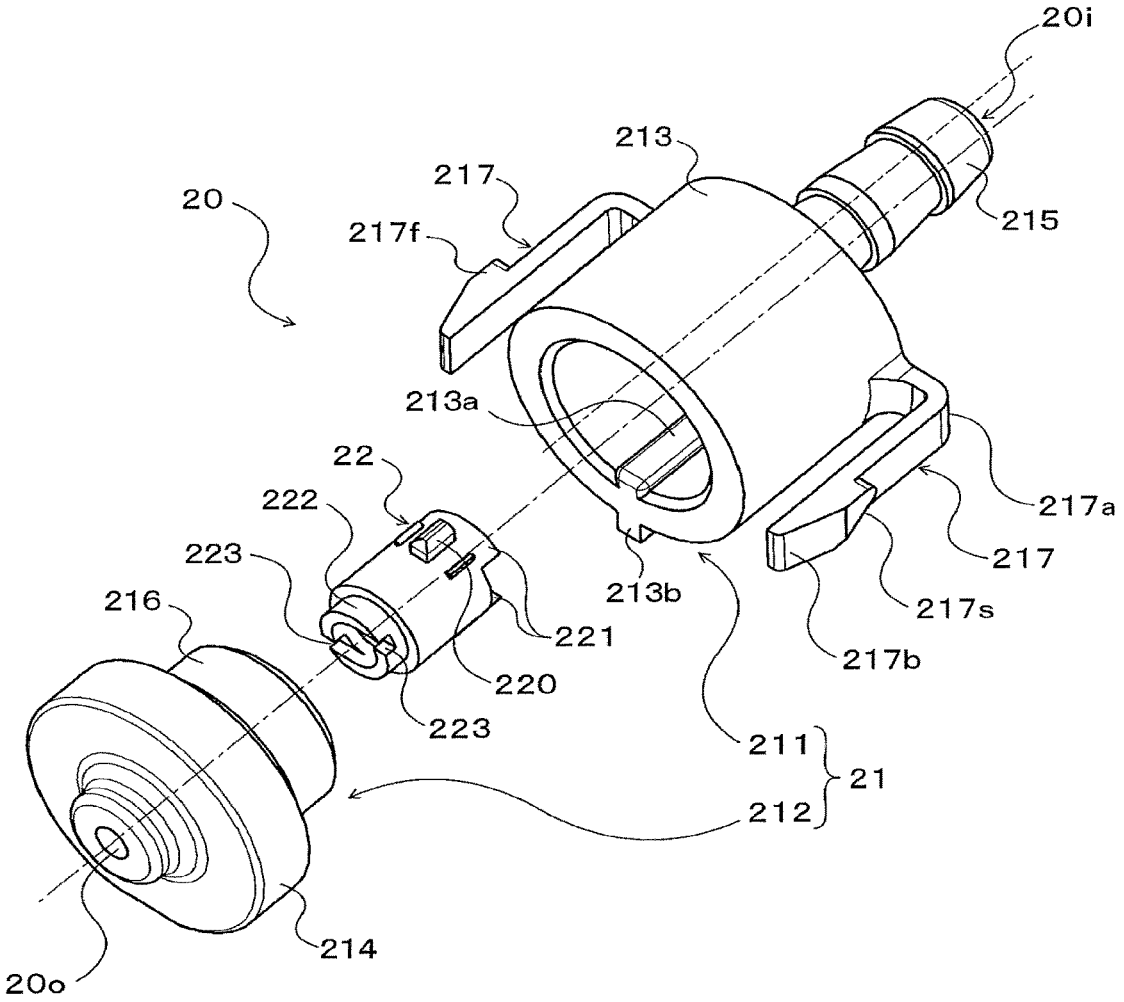
FIG. 6 is an exploded perspective view illustrating a sprayer included in the sanitary washing device disclosed here.
Figure 7:
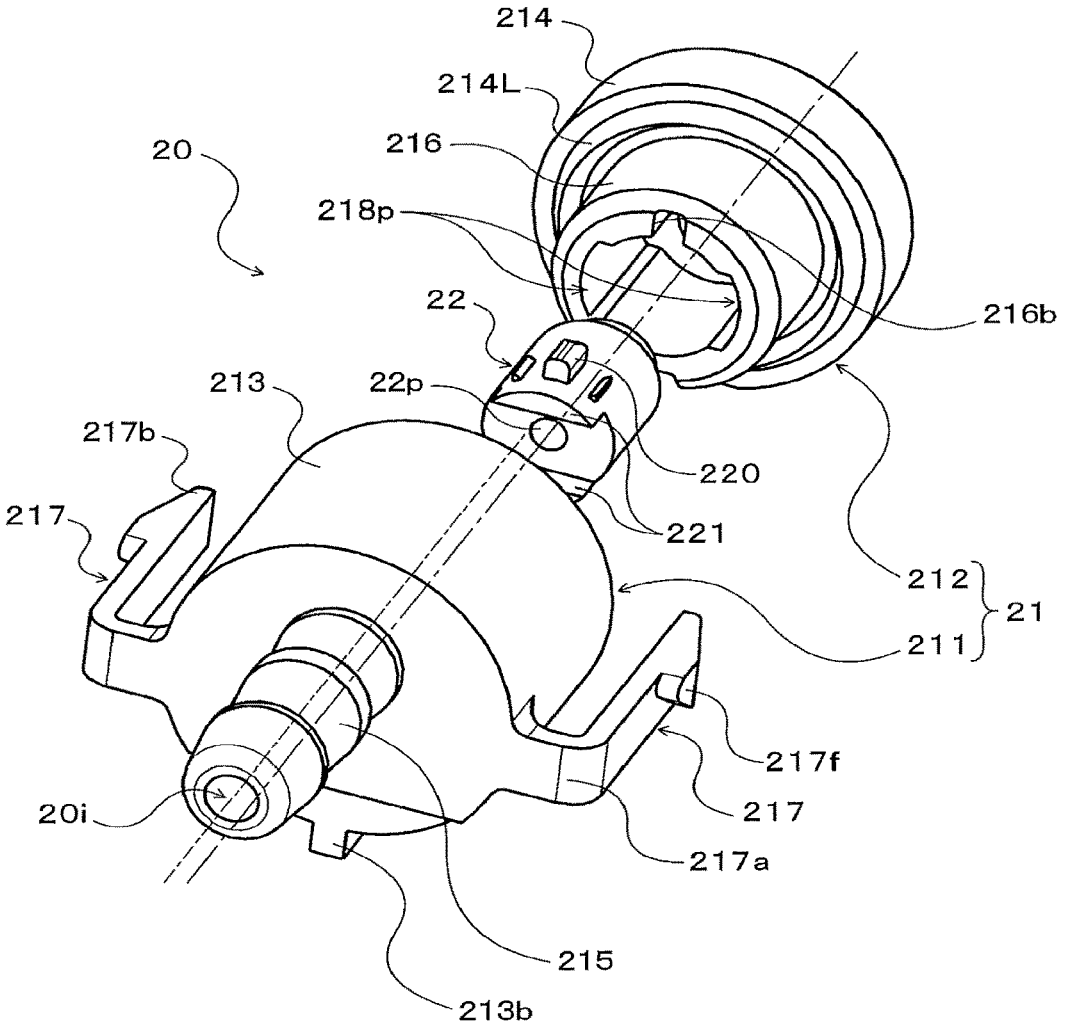
FIG. 7 is an exploded perspective view illustrating the sprayer included in the sanitary washing device disclosed here.
Figure 8:
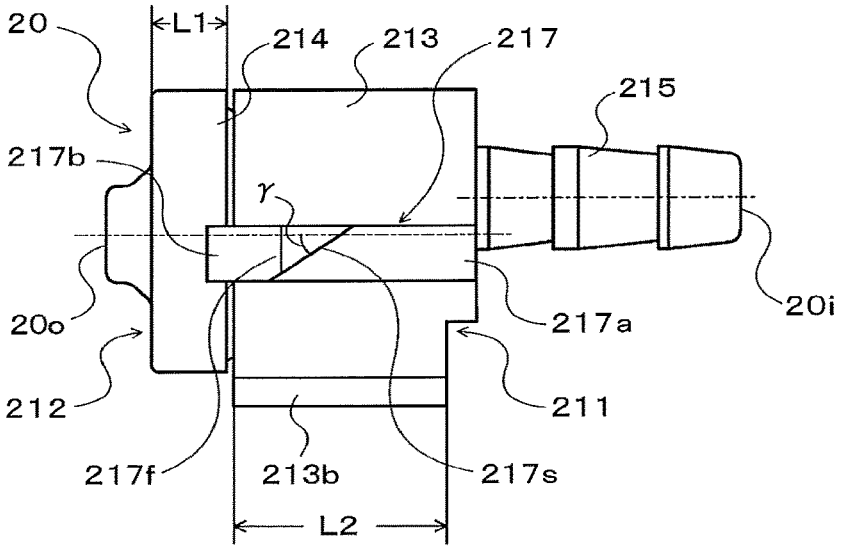
FIG. 8 is a side view illustrating the sprayer included in the sanitary washing device disclosed here.
Figure 9:
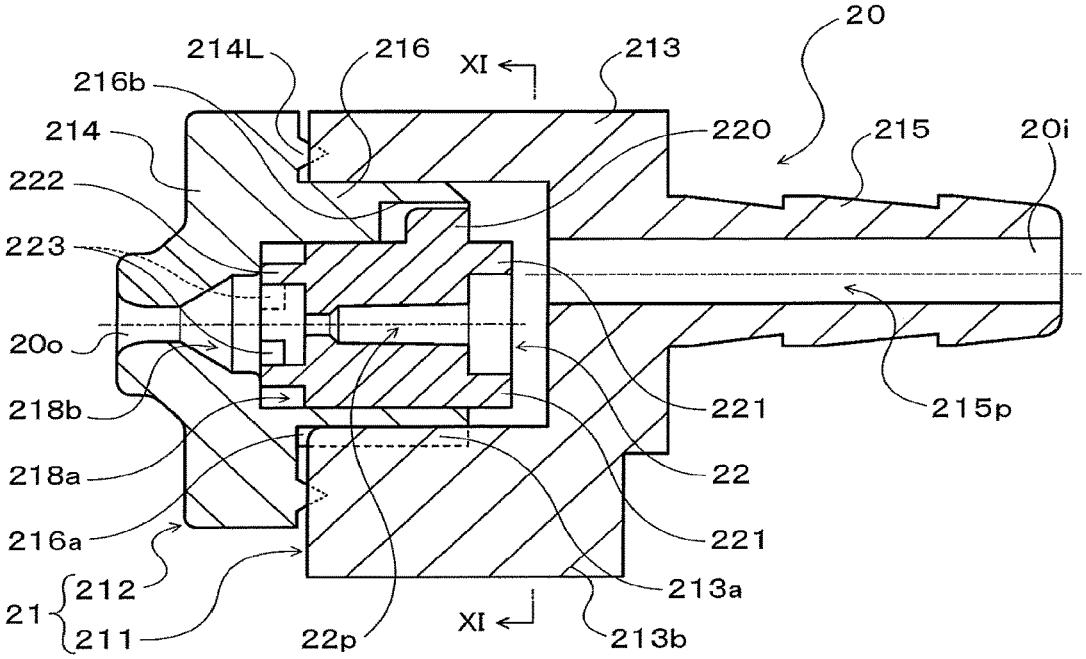
FIG. 9 is a cross-sectional view illustrating the sprayer included in the sanitary washing device disclosed here.
Figure 10:
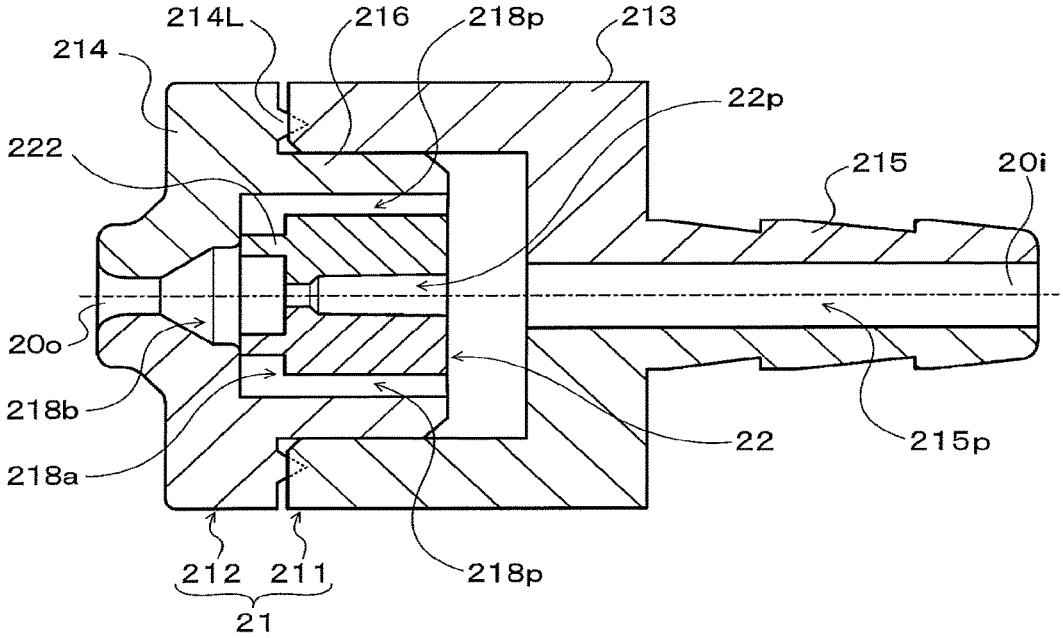
FIG. 10 is a cross-sectional view illustrating the sprayer included in the sanitary washing device disclosed here.

FIGS. 6 and 7 are exploded perspective views illustrating the sprayer 20, FIG. 8 is a side view illustrating the sprayer 20, and FIGS. 9 and 10 are cross-sectional views illustrating the sprayer 20. As illustrated in these drawings, the sprayer 20 includes a body 21 and a flow splitting member 22 disposed inside the body 21. The body 21 is configured by bonding a first cylindrical body 211 and a second cylindrical body 212, both of which are formed of a resin, to each other.

As illustrated in FIGS. 6 and 7, the first cylindrical body 211 includes a first large-diameter portion 213, which takes the form of a bottomed cylinder having a free end, and a first small-diameter portion 215, which extends from the end surface of the first large-diameter portion 213 in the axial direction of the first cylindrical body 211 and has a diameter smaller than that of the first large-diameter portion 213. A positioning protrusion 213*a* is formed inside the first large-diameter portion 213 so as to extend in the axial direction of the first large-diameter portion 213 for the positioning of the second cylindrical body 212. In addition, a rattling suppression protrusion 213*b* is formed on the outer peripheral surface of the first large-diameter portion 213 so as to extend in the axial direction of the first large-diameter portion 213, in order to suppress the sprayer 20 from rattling relative to the inclined portion 112 by coming into contact with the inclined portion 112 of the base plate 110.

The first small-diameter portion 215 is formed in a so-called barbed tubing connection type, and as illustrated in FIG. 9, has a supply path 215*p*, which extends in the axial direction of the first small-diameter portion 215 and communicates both with a supply port 20*i* of the sprayer 20 formed in the free end portion thereof and with the inside of the first large-diameter portion 213. The first small-diameter portion 215, i.e., the supply port 20*i* is connected to the rotary valve via a branch valve (not illustrated), which is provided on the downstream side of the above-described rotary valve. Thus, water from the water tank (or the heat exchanger having the heating heater) is supplied to the sprayer 20 (the supply port 20*i*) via the rotary valve. However, the first small-diameter portion 215 (the supply port 20*i*) may be connected to the tap water pipe via, for example, an opening/closing valve.

Moreover, as illustrated in FIGS. 6 and 7, the first cylindrical body 211 includes a pair of arm portions 217, which is integrally formed with the first large-diameter portion 213. Each arm portion 217 protrudes from the outer peripheral surface of the first large-diameter portion 213 so as to extend in the axial direction of the first large-diameter portion 213. A base end portion 217*a* of each arm portion 217 extends radially outward from the outer peripheral surface of the first large-diameter portion 213, and a gap is formed between a free end portion 217*b* of each arm portion 217 and the outer peripheral surface of the first large-diameter portion 213. Thus, each arm portion 217 may be elastically deformed so that the free end portion 217*b* approaches the outer peripheral surface of the first large-diameter portion 213.

In the embodiment disclosed here, the pair of arm portions 217 is symmetrically formed with respect to the center plane of the sprayer 20 in the width direction, i.e., a plane that includes the axial center of the first large-diameter portion 213 and the first small-diameter portion 215 (the supply path 215*p*) and the center axis of the rattling suppression protrusion 213*b* in the width direction, so that the free end portion 217*b* is located on a jetting port 20*o* side of the sprayer 20. In addition, a hook portion 217*f* is formed on the free end portion 217*b* of each arm portion 217 so as to protrude in a direction away from the outer peripheral surface of the first large-diameter portion 213. As illustrated in FIG. 8, the hook portion 217*f* has a flat inclined surface 217*s* on the base end portion 217*a* side of the arm portion 217, which is inclined so as to be more spaced apart from the rattling suppression protrusion 213*b*, i.e., from the inclined portion 112 (the base plate 110) in a direction from the free end portion 217*b* side to the base end portion 217*a* side. In addition, the tip end portion of the hook portion 217*f* is tapered, as illustrated in FIG. 6.

As illustrated in FIGS. 6 and 7, the second cylindrical body 212 includes a second large-diameter portion 214, which has the jetting port 20*o* formed therein, and a second small-diameter portion 216, which extends from the end surface opposite to the jetting port 20*o* of the second large-diameter portion 214 in the axial direction of the second cylindrical body 212 and has a diameter smaller than that of the second large-diameter portion 214. The second large-diameter portion 214 takes the form of a short cylinder having substantially the same outer diameter as the first large-diameter portion 213. As illustrated in FIG. 8, a length L1 from the end surface of the second large-diameter portion 214 that surrounds the jetting port 20*o* to the end surface on the second small-diameter portion 216 side is set to be smaller than a length L2 from the end surface of the first large-diameter portion 213 on the second cylindrical body 212 (open end) side to the end surface on the supply port 20*i* side.

Moreover, a welding rib 214L, which is an annular protrusion having a substantially triangular cross-sectional shape, is formed on the end surface of the second large-diameter portion 214 on the second small-diameter portion 216 side.

The second small-diameter portion 216 has an outer diameter slightly smaller than the inner diameter of the first large-diameter portion 213 of the first cylindrical body 211 and is inserted into the first large-diameter portion 213. When the second small-diameter portion 216 is formed to have a diameter slightly smaller than that of the first large-diameter portion 213, the assembly efficiency of the second cylindrical body 212 with respect to the first cylindrical body 211 may be increased. However, the second small-diameter portion 216 may have a diameter slightly larger than the diameter of the first large-diameter portion 213 so as to be press-fitted into the first large-diameter portion 213. In addition, as illustrated in FIGS. 9 and 10, the second small-diameter portion 216 is formed in a cylindrical shape having an axial length shorter than the axial length of the inner space of the first large-diameter portion 213. Moreover, a positioning groove 216*a* (see FIGS. 9 and 11) into which the positioning protrusion 213*a* of the first large-diameter portion 213 is fitted is formed in the outer peripheral surface of the second small-diameter portion 216.

As illustrated in FIGS. 9 and 10, inside the second cylindrical body 212 (the second large-diameter portion 214 and the second small-diameter portion 216), an accommodating portion 218*a*, in which the flow splitting member 22 is disposed, and a communication path 218*b*, which communicates the jetting port 20*o* and the accommodating portion 218*a* with each other, are formed. The accommodating portion 218*a* has a circular cross-sectional shape and is mainly defined by the second small-diameter portion 216 so as to extend coaxially with the jetting port 20*o*. The communication path 218*b* is formed so that the inner diameter thereof gradually decreases in a direction from the accommodating portion 218*a* toward the jetting port 20*o* and extends coaxially with the jetting port 20*o* and the accommodating portion 218*a*. In addition, the jetting port 20*o* is formed such that the inner diameter thereof gradually increases as the distance from the communication path 218*b* increases.

In the embodiment disclosed here, as illustrated in FIGS. 9 and 10, the accommodating portion 218*a*, the communication path 218*b*, and the jetting port 20*o* are formed in the second cylindrical body 212 such that the respective axial centers thereof are spaced apart (deviate) from the axial center of the supply path 215*p* of the first cylindrical body 211 (the first small-diameter portion 215) on the center plane when the second small-diameter portion 216 of the second cylindrical body 212 is inserted into the first large-diameter portion 213 of the first cylindrical body 211. Moreover, as illustrated in FIGS. 7 and 10, plural liquid passages 218*p* are formed in the inner peripheral surfaces of the second large-diameter portion 214 and the second small-diameter portion 216 that define the accommodating portion 218*a* so as to be recessed radially outward in the inner peripheral surfaces. In the embodiment disclosed here, two liquid passages 218*p* having an arcuate cross-sectional shape are formed in the second cylindrical body 212 so as to be symmetrical with respect to the center plane of the sprayer 20 in the width direction, and each liquid passage 218*p* is defined by a plane that extends parallel to the concave circumferential surface.

The flow splitting member 22 is a cylindrical member, which is formed of a resin and has a through-hole (liquid passage) 22*p*, which extends along the center axis and has a circular cross-sectional shape. The flow splitting member 22 has an outer diameter slightly smaller than the inner diameter of the accommodating portion 218*a* of the second cylindrical body 212. In addition, as illustrated in FIG. 6, a positioning protrusion 220 and plural (at least three (e.g., four in the embodiment disclosed here)) press-fitting ribs are formed on the outer peripheral surface of the flow splitting member 22. The flow splitting member 22 is disposed inside the second cylindrical body 212 such that the positioning protrusion 220 is fitted into the positioning groove 216*b* formed in the second small-diameter portion 216 of the second cylindrical body 212 and such that the plural press-fitting ribs are press-fitted into the inner peripheral surface of the accommodating portion 218*a*. Thus, the flow splitting member 22 is disposed inside the body 21 (the first and second cylindrical bodies 211 and 212) in a state where the axial center of the through-hole 22*p* and the axial center of the supply path 215*p* are deviated (spaced apart) from each other on the center plane.

Moreover, the flow splitting member 22 has two protrusions 221, which protrude in the axial direction from the end surface opposite to the jetting port 20*o* side and face each other in the radial direction. In the embodiment disclosed here, the outer peripheral surface of each protrusion 221 is a circumferential surface having the same radius of curvature as the outer peripheral surface of the flow splitting member 22, and the inner surface and the end surface of each protrusion 221 are flat surfaces. When the flow splitting member 22 is disposed in the accommodating portion 218*a* of the body 21 (the second cylindrical body 212), as illustrated in FIG. 9, the protrusion 221 located on the upper side in the drawing among the two protrusions 221 faces the supply path 215*p* of the first cylindrical body 211 with a gap therebetween in the axial direction, and, as illustrated in FIG. 11, the inner surface of each protrusion 221 extends parallel to a plane that defines the two liquid passages 218*p* when viewed in the axial direction.

In addition, the flow splitting member 22 has a short cylindrical swirling flow forming portion 222, which communicates with the through-hole 22*p*. As illustrated in FIG. 6, the swirling flow forming portion 222 is formed in a cylindrical shape having a diameter smaller than that of the outer peripheral surface of the flow splitting member 22, and protrudes in the axial direction from the end surface on the jetting port 20*o* side of the flow splitting member 22. When the flow splitting member 22 is disposed in the accommodating portion 218*a* of the body 21 (the second cylindrical body 212), an annular space is formed between the outer peripheral surface of the swirling flow forming portion 222 and the inner peripheral surface of the accommodating portion 218*a* to communicate with the respective liquid passages 218*p* of the second cylindrical body 212, and the inside of the swirling flow forming portion 222 communicates with the jetting port 20*o* through the communication path 218*b*.

Figure 11:
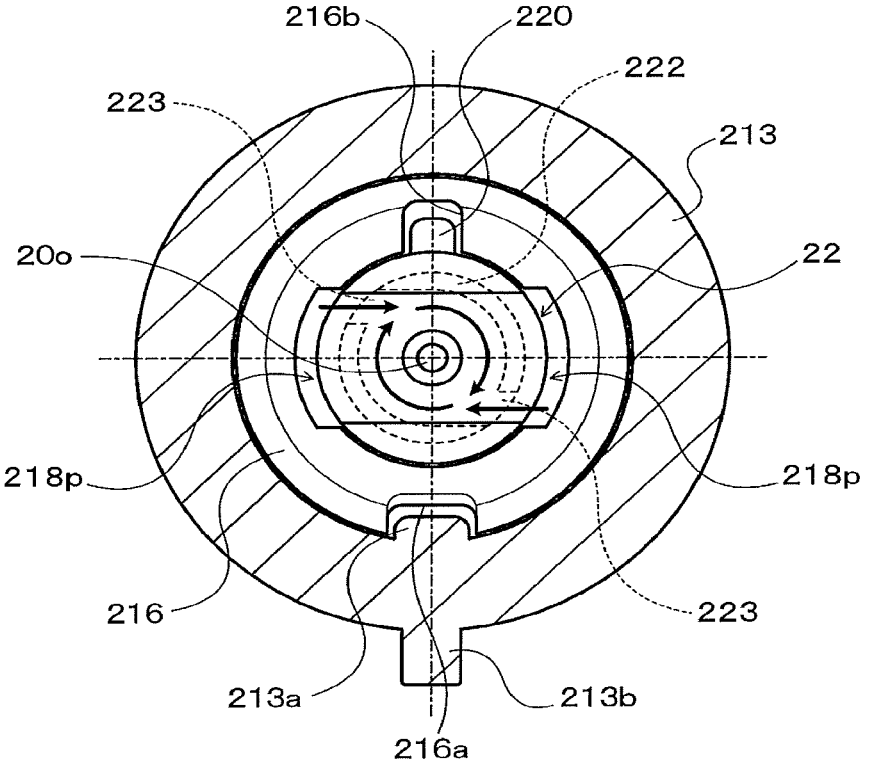
FIG. 11 is a cross-sectional view taken along line XI-XI of FIG. 9.

As illustrated in FIGS. 6, 9 and 11, the swirling flow forming portion 222 is formed with two liquid inlet ports 223, which extend in the tangential direction of the inner peripheral surface of the swirling flow forming portion 222. In the embodiment disclosed here, the two liquid inlet ports 223 are formed at point-symmetrical positions with respect to the center of the swirling flow forming portion 222 (the axial center of, for example, the jetting port 20*o*). In addition, in the embodiment disclosed here, each liquid inlet port 223 has a rectangular cross-sectional shape, and, as can be seen from FIG. 11, a plane that defines each liquid inlet port 223 includes a plane that is in contact with the inner peripheral surface of the swirling flow forming portion 222. When the flow splitting member 22 is disposed in the accommodating portion 218*a* of the body 21 (the second cylindrical body 212), as illustrated in FIG. 11, each liquid inlet port 223 is located slightly closer to the jetting port 20*o* side than the plane that defines the corresponding liquid passage 218*p* of the second cylindrical body 212 when viewed in the axial direction. Thus, the liquid inlet port 223, i.e. the inside of the swirling flow forming portion 222 communicates with the corresponding (close) liquid passage 218*p* through the peripheral annular space.

When assembling the sprayer 20 including the first and second cylindrical bodies 211 and 212 and the flow splitting member 22 described above, the flow splitting member 22 is disposed in the accommodating portion 218*a* of the second cylindrical body 212 such that the positioning protrusion 220 is fitted into the positioning groove 216*b* of the second small-diameter portion 216 and the plural press-fitting ribs are press-fitted into the inner peripheral surface of the accommodating portion 218*a*. Thus, the flow splitting member 22 may be positioned in the second cylindrical body 212 (the body 21) such that the two liquid passages 218*p* are located on opposite sides in the space between the two protrusions 221 and the liquid inlet port 223 of the swirling flow forming portion 222 communicates with the corresponding liquid passage 218*p*. In addition, the second small-diameter portion 216 in which the flow splitting member 22 is assembled is inserted into the first large-diameter portion 213 such that the welding rib 214L of the second large-diameter portion 214 is in contact with the end surface of the first large-diameter portion 213 of the first cylindrical body 211 and the positioning protrusion 213*a* is fitted in the positioning groove 216*a*. In addition, in the state in which the second cylindrical body 212 is pressed against the first cylindrical body 211, ultrasonic waves are applied from an ultrasonic wave generator (not illustrated) to the end surface that surrounds the jetting port 20*o* of the second large-diameter portion 214.

Thus, when the tip end portion of the annular welding rib 214L is melted, the second large-diameter portion 214, i.e. the second cylindrical body 212 is bonded to the first large-diameter portion 213, i.e. the first cylindrical body 211 in a liquid-tight manner. Therefore, the first and second cylindrical bodies 211 and 212 of the sprayer 20 may be bonded to each other in a liquid-tight manner without using a fastening member such as a bolt or a sealing member, and the reduction of the entire sprayer 20 may be ensured. In addition, in the sprayer 20, the length L1 between both the end surfaces of the second large-diameter portion 214 is set to be shorter than the length L2 between both the end surfaces of the first large-diameter portion 213. Thus, by applying ultrasonic waves from the end surface of the second large-diameter portion 214 on the jetting port 20*o* side, the welding rib 214L may be satisfactorily welded to the end surface of the first large-diameter portion 213 of the first cylindrical body 211.

Figure 12:
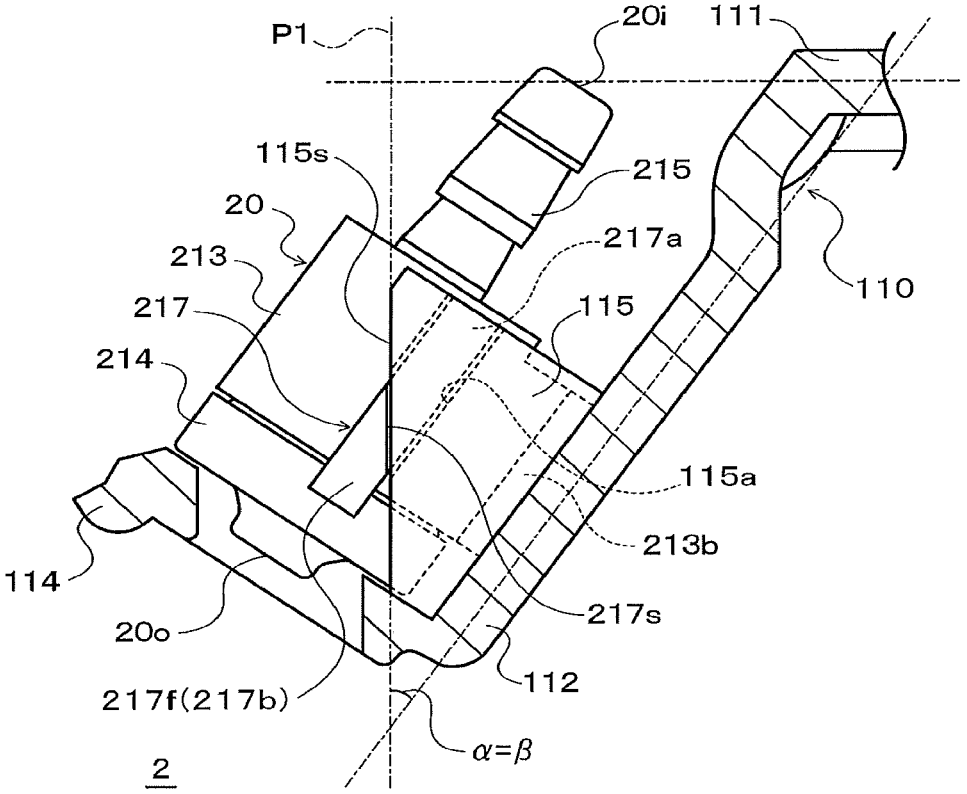
FIG. 12 is a partial cross-sectional view illustrating a state where the sprayer is attached to a base member of the sanitary washing device.
Figure 13:
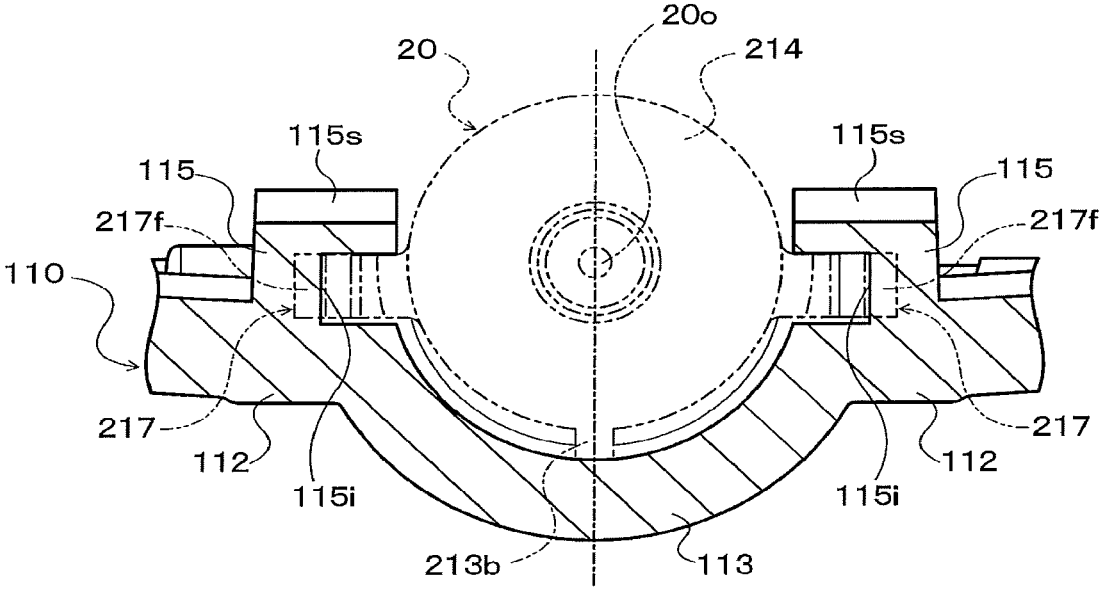
FIG. 13 is a partial cross-sectional view illustrating a state where the sprayer is attached to the base member of the sanitary washing device.

FIGS. 12 and 13 are partial cross-sectional views illustrating the state where the sprayer 20 is attached to the inclined portion 112 of the base plate 110. As illustrated in FIGS. 12 and 13, the inclined portion 112 of the base plate 110 is provided with a mounting portion 113, on which the sprayer 20 is mounted, a distal end wall portion 114, which has an opening configured to expose the jetting port 20*o* of the sprayer 20, and a pair of engagement portions 115, which may be engaged with the corresponding arm portions 217 of the sprayer 20. The mounting portion 113 is formed to have an arcuate cross-sectional shape along the outer peripheral surfaces of the first and second large-diameter portions 213 and 214 of the sprayer 20, and the surface of the mounting portion 113 is in contact with the rattling suppression protrusion 213*b*, which is formed on the first cylindrical body 211 (the first large-diameter portion 213) of the sprayer 20.

In addition, each engagement portion 115 has a groove 115*a*, through which the arm portion 217 of the sprayer 20 may be inserted, and a flat support surface 115*s*, which is inclined to be in contact with the inclined surface 217*s* of the hook portion 217*f*. In the embodiment disclosed here, each engagement portion 115 has a substantially right-angled triangular lateral shape, and the support surface 115*s* is located on the distal end wall portion 114 side, i.e. on the toilet bowl portion 2 side, and extends from the vicinity of the corresponding side edge of the mounting portion 113 to the flat portion 111 (the upper side in the drawing) side such that the grooves 115*a* face each other with the mounting portion 113 interposed therebetween. In addition, the angle $\alpha$ between the support surface 115*s* of each engagement portion 115 and the extending direction of the inclined portion 112 is set to be equal to the angle $\beta$ between a plane P1 (see FIG. 12) orthogonal to the extending direction of the flat portion 111 of the base plate 110 and the extending direction of the inclined portion 112 and the inclination angle $\gamma$ of the inclined surface 217*s* of the arm portion 217 (the angle between the inclined surface 217*s* and the axial center of the first large-diameter portion 213 (see FIG. 8)). Moreover, the distance between inner surfaces 115*i* of the grooves 115*a*, which face each other, is set to be slightly shorter than the width between portions of the pair of arm portions 217 closer to the base end portions 217*a* than the hook portions 217*f*.

Figure 14:
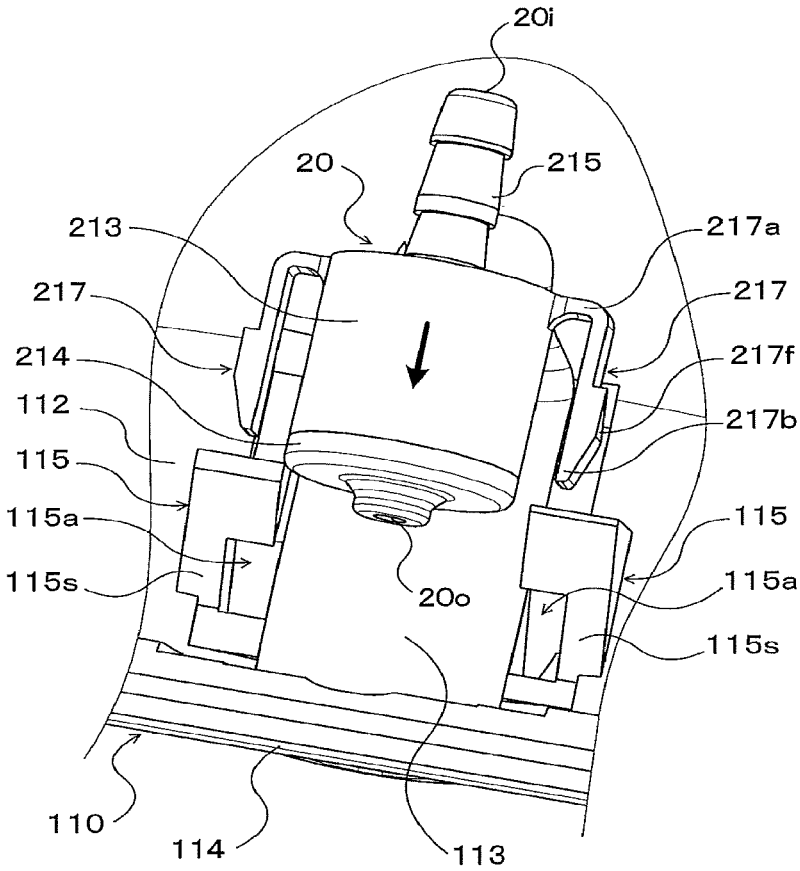
FIG. 14 is a perspective view illustrating a sequence of attaching the sprayer to the base member of the sanitary washing device.

When attaching the sprayer 20 to the inclined portion 112 including the pair of engagement portions 115 as described above, after, for example, a hose (not illustrated) is connected to the first small-diameter portion 215 (the supply port 20*i*) of the sprayer 20, as illustrated in FIG. 14, the sprayer 20 is pushed between the pair of engagement portions 115 from the flat portion 111 side to the distal end wall portion 114 side while bringing the rattling suppression protrusion 213*b* into contact with the surface of the mounting portion 113. As the sprayer 20 is pushed between the pair of engagement portions 115, each arm portion 217 passes through the groove 115*a* in the corresponding engagement portion 115 while being elastically deformed such that the free end portion 217*b* (the hook portion 217 *f*) side thereof approaches the outer peripheral surface of, for example, the first large-diameter portion 213. Then, when the hook portion 217*f* of each arm portion 217 has come closer to the distal end wall portion 114 side than the groove 115*a*, the portion of each arm portion 217 closer to the base end portion 217*a* than the hook portion 217*f* is tightly pushed onto the inner surface 115*i* of the corresponding groove 115*a* by the elasticity of the arm portion 217. In addition, the inclined surface 217*s* of each hook portion 217*f* is in contact with the support surface 115*s* of the corresponding engagement portion 115.

In this way, by elastically deforming each arm portion 217 to be introduced into the groove 115*a* in the corresponding engagement portion 115 such that the free end portion 217*b* (the hook portion 217*f*) approaches the outer peripheral surface and then elastically fitting each arm portion 217 into the groove 115*a*, the sprayer 20 may be fixed to the inclined portion 112 of the base plate 110 by snap-fitting without using a fastening member. In addition, by bringing the inclined surface 217*s* formed on the hook portion 217*f* of each arm portion 217 into contact with the support surface 115*s* of the corresponding engagement portion 115, it is possible to satisfactorily regulate the rotation of the sprayer 20 even if there is some rattling between the groove 115*a* and the arm portion 217 in a direction orthogonal to the extending direction of the arm portion 217. As a result, the sprayer 20 may be properly fixed to the inclined portion 112 of the base plate 110 while suppressing an increase in installation space.

Subsequently, descriptions will be made of an operation related to the sprayer 20 included in the sanitary washing device 10 configured as described above.

A control device (not illustrated) of the sanitary washing device 10 controls the above-described actuator so as to move one of the cylinder portions 15*s* and 16*s* to the toilet bowl portion 2 side when it is determined that the user sits on the toilet bowl 1 (the seat 12) based on a signal from the seating sensor 19 and a signal from a seating switch (not illustrated), which is turned on in conjunction with rotation of the hinge portion of the seat 12. When one of the cylinder portions 15*s* and 16*s* moves toward the toilet bowl portion 2, the pressing portion 15*p* or 16*p* presses the slider 180 of the link mechanism 18, causing the slider 180 to move toward the shutter 17. Thereby, the first and second links 181 and 182 move to press the shutter 17 in conjunction with the movement of the slider 180, and the shutter 17 rotates such that it jumps up about the hinge 17*h*. In addition, the control device stops the cylinder portion 15*s* or 16*s* at the timing when the slider 180 of the link mechanism 18 comes into contact with one end of the guide portion 11*g*. Thus, a portion of the shutter 17 is supported by the cylinder portion 15*s* or 16*s* such that the shutter 17 is maintained at the opened position.

Subsequently, the control device of the sanitary washing device 10 controls the rotary valve so that water is supplied from the water tank (or the heat exchanger having the heating heater) to the supply port 20*i* of the sprayer 20. When the water is supplied to the supply port 20*i* of the sprayer 20, the supplied water moves inside the supply path 215*p* of the sprayer 20 and is introduced into the first large-diameter portion 213. Some of the water introduced into the first large-diameter portion 213 is introduced into the through-hole 22*p* in the flow splitting member 22 and moves straight toward the jetting port 20*o*. In addition, some of the water introduced into the first large-diameter portion 213 is introduced into two liquid passages 218*p* formed in the second cylindrical body 212 and moves straight along the outer peripheral surface of the flow splitting member 22 toward the annular space between the outer peripheral surface of the swirling flow forming portion 222 and the inner peripheral surface of the accommodating portion 218*a*.

Here, in the sprayer 20 of the embodiment disclosed here, instead of forming a liquid passage in the outer peripheral surface of the flow splitting member 22, the two liquid passages 218*p* are formed in the inner peripheral surface of the second cylindrical body 212, which constitutes the body 21. Thus, by appropriately setting the cross-sectional areas of the through-hole 22*p* and the two liquid passages 218*p*, it is possible to appropriately split the water from the supply port 20*i* into multiple water stream components between the supply port 20*i* and the jetting port 20*o* by the flow splitting member 22. In addition, the flow splitting member 22 may be easily reduced in diameter, compared to a case where plural liquid passages are formed in the outer peripheral surface of the flow splitting member 22.

Moreover, in the sprayer 20, the flow splitting member 22 is disposed inside the body 21 in the state where the axial center of the through-hole 22*p* and the axial center of the supply path 215*p* are not aligned with each other, and the flow splitting member 22 is formed with the protrusion 221, which protrudes to the supply path 215*p* side to face the supply path 215*p* with a gap therebetween. Thus, in the sprayer 20, the water discharged from the supply path 215*p* may be caused to collide with the protrusion 221, which faces the supply path 215*p* such that water may be properly distributed by the through-hole 22*p* of the flow splitting member 22 and the two liquid passages 218*p* and the flow rate of water introduced into the two liquid passages 218*p* may be optimized.

In addition, the water, which has passed through each liquid passage 218*p*, is introduced from the annular space into the swirling flow forming portion 222 through the liquid inlet port 223. As described above, each liquid inlet port 223 extends in the tangential direction of the inner peripheral surface of the swirling flow forming portion 222, and the flow splitting member 22 is positioned in the second cylindrical body 212 (the body 21) such that the liquid inlet port 223 communicates with the corresponding liquid passage 218*p*. Therefore, the sprayer 20 may efficiently form a swirling flow in the swirling flow forming portion 222 and may push the swirling water by the water from the through-hole 22*p* so that the water may be jetted from the jetting port 20*o*. Therefore, in the state where the shutter 17 is maintained at the opened position thereof, the water from the jetting port 20*o* of the sprayer 20 may be swirled and spirally jetted to evenly spread over a wider range of the surface of the toilet bowl portion 2.

As described above, in the sanitary washing device 10, in the state where the shutter 17 serving as the movable-type scattering suppression member is rotated from the closed position to the opened position thereof, water may be jetted from the sprayer 20 to the surface of the toilet bowl portion 2 of the toilet bowl 1. Thus, even if the water is jetted from the sprayer 20 to the toilet bowl portion 2 in the state where the user sits on the toilet bowl 1, it is possible to suppress the jetted water (water droplets) from scattering to the upper surface side of the toilet bowl 1 by the shutter 17 having a relatively large width (see FIG. 2), and it is possible to satisfactorily suppress the scattered water droplets from adhering to the hips or legs of the user. In addition, by spraying the water from the sprayer 20 to the toilet bowl portion 2, it is possible to smoothen the surface of the toilet bowl portion 2 so as to make it difficult for dirt to adhere thereto, and it is possible to interpose a water film between dirt and the surface of the toilet bowl portion 2 so as to cause the dirt to be easily removed from the surface of the toilet bowl portion 2 upon washing of the toilet bowl.

As a result, it is possible to suppress dirt from adhering to the surface of the toilet bowl portion 2 of the toilet bowl 1 without giving the user discomfort. In addition, since the shutter 17 is of a movable type, it is possible to return the shutter 17 to the closed position when no water is jetted from the sprayer 20. Therefore, it is possible to prevent the shutter 17 from interrupting, for example, other functions of the sanitary washing device 10, and to prevent the shutter 17 from interrupting, for example, the cleaning of the toilet bowl 1. In addition, since the plural liquid passages 218*p* are formed in the second cylindrical body 212 to reduce the size of the sprayer 20, it is possible to suppress an increase in the size of the sanitary washing device 10 due to the installation of the sprayer 20.

In addition, the shutter 17 of the sanitary washing device 10 rotates (moves) between the closed position and the opened position in conjunction with the forward and backward movements of the cylinder portions 15*s* and 16*s* of the hip washing nozzle 15 and the bidet nozzle 16, which are human-body washing nozzles. Thus, it is possible to suppress an increase in the size or cost of the sanitary washing device 10 due to the installation of the drive device of the shutter 17.

Moreover, in the sanitary washing device 10, the shutter 17 is configured to cover the tip end portions of the hip washing nozzle 15 and the bidet nozzle 16 at the closed position thereof. That is, the shutter 17 also serves as a nozzle shutter for suppressing contamination of the hip washing nozzle 15 and the bidet nozzle 16. Thus, it is possible to suppress an increase in the size or cost of the sanitary washing device 10 due to the installation of the shutter 17 for the sprayer 20.

In addition, the sanitary washing device 10 includes the casing 11, which accommodates the hip washing nozzle 15 and the bidet nozzle 16 therein and rotatably supports the shutter 17, and the link mechanism 18 serving as a motion conversion mechanism that converts a linear motion of the cylinder portions 15*s* and 16*s* of the hip washing nozzle 15 and the bidet nozzle 16 in the axial direction into a rotational motion of the shutter 17. Thus, it possible to rotate the shutter 17 in conjunction with the movement of the cylinder portions 15*s* and 16*s*. Moreover, by converting the linear motion of the cylinder portions 15*s* and 16*s* into the rotational motion of the shutter 17 by the link mechanism 18, it is possible to rotate the shutter 17 from the closed position to the opened position, regardless of whether or not the nozzle bodies 15*n* and 16*n* move back and forth.

In addition, in the sanitary washing device 10, the shutter 17 may be configured to rotate (move) between the closed position and the opened position in conjunction with the forward and backward movements of the nozzle bodies 15*n* and 16*n* of the hip washing nozzle 15 and the bidet nozzle 16. In addition, the shutter 17 may be configured to move (rotate) to the opened position by being pressed by the hip washing nozzle 15 and the bidet nozzle 16 (the nozzle bodies 15*n* and 16*n*), which move to the toilet bowl portion 2 side, and to move (rotate) to the closed position by being urged by the spring when the nozzles 15 and 16 (the nozzle bodies 15*n* and 16*n*) are moved into the casing 11.

Figure 15:
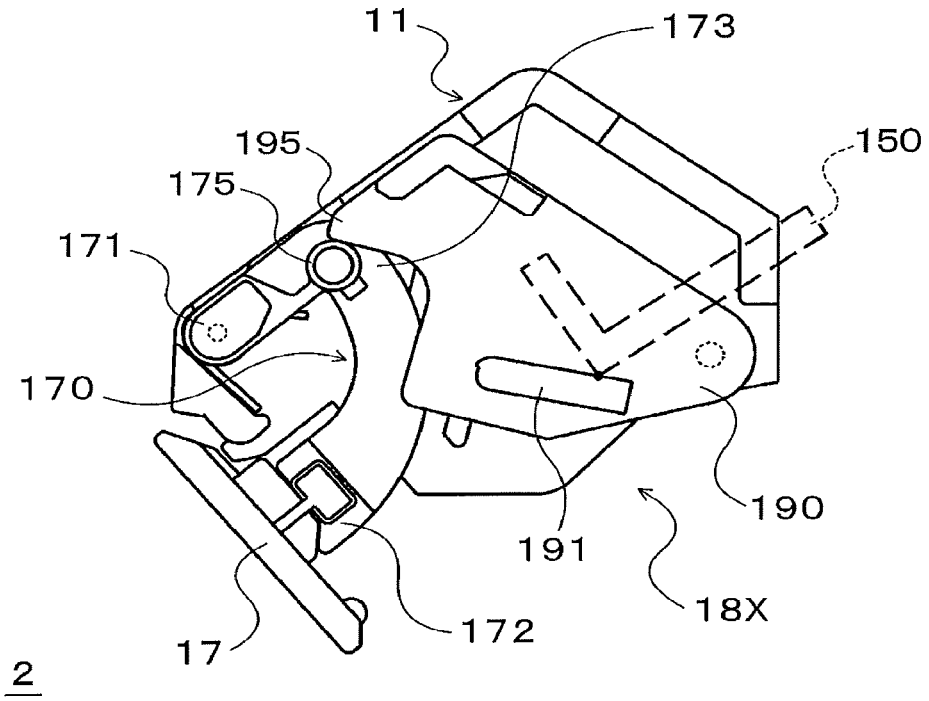
FIG. 15 is an enlarged view illustrating the major part of another sanitary washing device disclosed here.

Moreover, in the sanitary washing device 10, the motion conversion mechanism includes the first link 181, which is pin-coupled to the slider 180, on one end side thereof and the slider 180, which is guided by the casing 11 and is pressed by the cylinder portions 15*s* and 16*s*, on the other end side thereof, but is not limited thereto. That is, the sanitary washing device 10 may be provided with a motion conversion mechanism illustrated in FIGS. 15 and 16. A motion conversion mechanism 18X illustrated in FIGS. 15 and 16 includes a pressing member 150, a connection member 170, which is rotatably supported by the casing and is fixed to the shutter 17, and a rotating member 190, which is rotatably supported by the casing 11 via a support shaft.

The pressing member 150 may move back and forth in the axial direction of the cylinder portion, along with at least one of the cylinder portion of the hip washing nozzle and the cylinder portion of the bidet nozzle, both of which are not illustrated. The connection member 170 includes a base end portion (one end portion) 171 rotatably supported by the casing 11, a fixing portion (the other end portion) 172 fixed to the shutter 17, a curved portion (bent portion) 173 formed between the base end portion 171 and the fixing portion 172, and a pressed portion 175 (e.g., a roller) provided in the curved portion 173. Moreover, a spring (not illustrated) is interposed between the connection member 170 and the casing 11, and the connection member 170 is urged to the closed position side of the shutter 17 illustrated in FIG. 15 by the spring.

The rotating member 190 has a pressed portion 191 and a pressing portion 195. The pressed portion 191 is disposed to be spaced apart from the support shaft and has a contact surface, which may be in contact with the end portion of the pressing member 150. As illustrated, the contact surface of the pressed portion 191 is inclined to be spaced apart from the support shaft, thereby being spaced apart from a plane orthogonal to the movement direction of the pressing member 150. The pressing portion 195 of the rotating member 190 is formed to be more spaced apart from the support shaft than the pressed portion 191.

In the motion conversion mechanism 18X, when the cylinder portion of, for example, the hip washing nozzle is moved toward the toilet bowl portion 2, the pressed portion 191 of the rotating member 190 is pressed by the pressing member 150, which moves toward the toilet bowl portion 2 along with the cylinder portion. Thus, the rotating member 190 rotates around the support shaft from the upper surface side of the toilet bowl to the toilet bowl portion 2 side (in the counterclockwise direction in the drawing), whereby the pressing portion 195 of the rotating member 190 presses the pressed portion 175 of the connection member 170. Then, the pressed portion 175 of the connection member 170 moves from the upper surface side of the toilet bowl to the toilet bowl portion 2 side by being pressed by the pressing portion 195 of the rotating member 190, whereby the connection member 170 rotates around a support shaft on the base end portion 171. As a result, the shutter 17 rotates from the closed position illustrated in FIG. 15 to the opened position illustrated in FIG. 16 against the biasing force of the spring.

Figure 16:
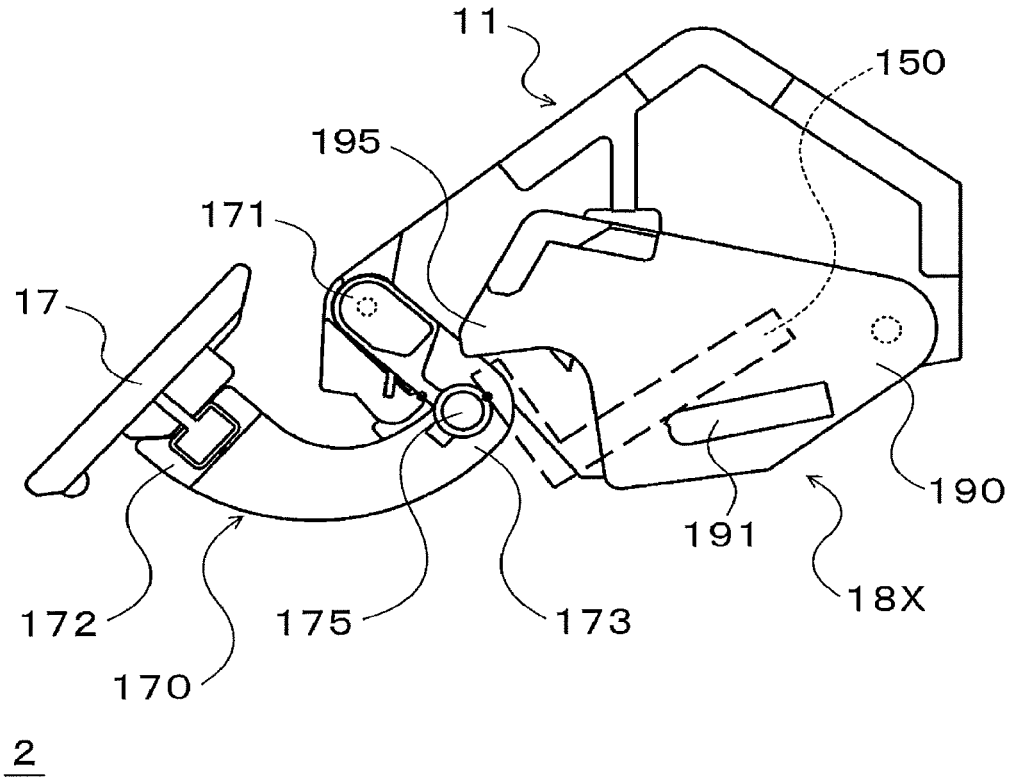
FIG. 16 is an enlarged view illustrating the major part of a further sanitary washing device disclosed here.

In addition, as illustrated in FIG. 16, when the pressing member 150 (the cylinder portion) is moved toward the toilet bowl portion 2, the pressed portion 191 is no longer substantially in contact with the pressing member 150 due to change in posture (collapse) of the pressed portion 191 depending on the rotation of the rotating member 190, whereby the rotation of the rotating member 190 stops. Then, in the motion conversion mechanism 18X, as illustrated in FIG. 16, at a timing slightly earlier than the stop of rotation of the rotating member 190, contact between the pressed portion 175 of the connection member 170 and the pressing portion 195 of the rotating member 190 is released, and a portion of the pressing member 150 is brought into contact with a portion of the connection member 170. That is, the rotating member 190 is pressed by the pressing member 150 (the cylinder portion) during at least a part of the linear motion of the pressing member 150 (the cylinder portion), and the connection member 170 is pressed by the pressing member 150 (the cylinder portion) during at least a part of the linear motion of the pressing member 150 (the cylinder portion). The pressing of the connection member 170 by the pressing member 150 (the cylinder portion) is initiated before the pressing of the rotating member 190 by the pressing member 150 (the cylinder portion) is terminated, and the pressing of the connection member 170 by the pressing member 150 (the cylinder portion) is initiated after the pressing of the rotating member 190 by the pressing member 150 (the cylinder portion) is terminated. Thus, when the pressing member 150 (the cylinder portion) stops, the shutter 17 is supported by a portion of the pressing member 150, thereby being maintained at the opened position.

Even with the motion conversion mechanism 18, as described above, it is possible to rotate the shutter 17 in conjunction with the movement of the cylinder portions of the hip washing nozzle and the bidet nozzle. In addition, by converting a linear motion of the cylinder portion into a rotational motion of the shutter 17 by the motion conversion mechanism 18X, it is possible to rotate the shutter 17 from the closed position to the opened position, regardless of whether or not the nozzle body of, for example, the hip washing nozzle moves back and forth. In addition, in the sanitary washing device including the motion conversion mechanism 18X, when the pressing member 150 moves from the toilet bowl portion 2 to the inner side in the casing 11, the shutter 17 returns to the closed position (not illustrated) by the biasing force of the spring provided between the shutter 17 and the casing 11.

A sanitary washing device according to an aspect of this disclosure is a sanitary washing device including a sprayer that jets a liquid to a surface of a toilet bowl portion of a toilet bowl and a movable-type scattering suppression member that is movable between a closed position and an opened position and suppresses the liquid jetted from the sprayer from scattering to an upper surface side of the toilet bowl at the opened position.

In the sanitary washing device, the liquid can be jetted from the sprayer to the surface of the toilet bowl portion of the toilet bowl in a state where the movable-type scattering suppression member has been moved from the closed position to the opened position. Thus, even if the liquid is jetted from the sprayer to the toilet bowl portion in a state where a user sits on the toilet bowl, it is possible to suppress the jetted liquid (water droplets) from scattering to the upper surface side of the toilet bowl by the scattering suppression member, and thus, it is possible to satisfactorily suppress the water droplets from scattering and adhering to the hips or legs of the user. Then, by jetting the liquid from the sprayer to the toilet bowl portion, it is possible to smoothen the surface of the toilet bowl portion so as to make it difficult for dirt to adhere thereto, and it is also possible to interpose a liquid film between dirt and the surface of the toilet bowl portion so as to allow the dirt to be easily removed from the surface of the toilet bowl portion when the toilet bowl is washed. As a result, it is possible to suppress dirt from adhering to the surface of the toilet bowl portion of the toilet bowl without giving the user discomfort. In addition, since the scattering suppression member is of a movable type, it is possible to return the scattering suppression member to the closed position when no liquid is jetted from the sprayer. Therefore, it is possible to suppress the scattering suppression member from interrupting, for example, other functions of the sanitary washing device, and it is also possible to prevent the scattering suppression member from becoming an obstacle, for example, upon cleaning of the toilet bowl.

In addition, the sanitary washing device may further include a human-body washing nozzle that is movable back and forth and jets a liquid to a local region of a human body, and the scattering suppression member may move between the closed position and the opened position in conjunction with the forward and backward movements of the human-body washing nozzle. With this configuration, it is possible to suppress an increase in the size or cost of the sanitary washing device due to the installation of a drive device for the scattering suppression member.

The scattering suppression member may cover a tip end portion of the human-body washing nozzle at the closed position. That is, the scattering suppression member may also serve as a nozzle shutter for suppressing contamination of the human-body washing nozzle. With this configuration, it is possible to suppress an increase in the size or cost of the sanitary washing device due to the installation of the scattering suppression member for the sprayer.

The sanitary washing device may further include a casing that includes a base member configured to hold the sprayer, accommodates the human-body washing nozzle therein, and rotatably supports the scattering suppression member, and a motion conversion mechanism that converts a linear motion of the human-body washing nozzle into a rotational motion of the scattering suppression member. With this configuration, it is possible to rotate the scattering suppression member in conjunction with the movement of the human-body washing nozzle.

The human-body washing nozzle may include a nozzle body having a liquid jetting port and a cylinder portion that accommodates the nozzle body therein, the nozzle body may be movable back and forth relative to the cylinder portion, the cylinder portion may be movable back and forth relative to the casing, and the motion conversion mechanism may be one that converts a linear motion of the cylinder portion into a rotational motion of the scattering suppression member. With this configuration, it is possible to rotate the scattering suppression member from the closed position to the opened position, regardless of whether or not the nozzle body moves back and forth.

The motion conversion mechanism may be a link mechanism having one end connected to the scattering suppression member, and the link mechanism may include a slider provided on the other end side thereof, the slider being guided by the casing and pressed by the cylinder portion.

The motion conversion mechanism may include a connection member that includes one end portion rotatably supported by the casing, the other end portion fixed to the scattering suppression member, a curved portion formed between the one end portion and the other end portion, and a pressed portion provided on the curved portion, and a rotating member that is rotatably supported by the casing, is pressed and rotated by the cylinder portion, and presses the pressed portion of the connection member so as to allow the connection member to rotate relative to the casing.

The rotating member may be pressed by the cylinder portion during at least a part of the linear motion of the cylinder portion, the connection member may be pressed by the cylinder portion during at least a part of the linear motion of the cylinder portion; pressing of the connection member by the cylinder portion may be initiated before pressing of the rotating member by the cylinder portion is terminated, and the pressing of the connection member by the cylinder portion may be continued after the pressing of the rotating member by the cylinder portion is terminated.

In addition, it should be noted that this disclosure is not limited to the above embodiment at all and it is needless to say that various modifications can be made within the scope of the extension of this disclosure. In addition, the above-described embodiment is merely a specific form of the disclosure described in the "Summary" of the disclosure and does not limit the elements of the disclosure described in the "Summary" of the disclosure.

This disclosure can be used in the manufacturing industry of sprayers and sanitary washing devices, or the like.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A sanitary washing device comprising:

a sprayer that jets a liquid to a surface of a toilet bowl portion of a toilet bowl;

a human-body washing nozzle that includes a cylinder portion;

a movable-type scattering suppression member that is movable between a closed position and an opened position and suppresses the liquid jetted from the sprayer from scattering to an upper surface side of the toilet bowl at the opened position;

a casing configured to hold the sprayer, accommodate the human-body washing nozzle, and rotatably support the scattering suppression member;

a connection member that includes one end portion rotatably supported by the casing, the other end portion fixed to the scattering suppression member; and a rotating member that is rotatably supported by the casing, pressed and rotated by the cylinder portion, wherein the rotating member is pressed by the cylinder portion during at least a part of the linear motion of the cylinder portion, the connection member is pressed by the cylinder portion during at least a part of the linear motion of the cylinder portion;

pressing of the connection member by the cylinder portion is initiated before pressing of the rotating member by the cylinder portion is terminated, and the pressing of the connection member by the cylinder portion is continued after the pressing of the rotating member by the cylinder portion is terminated.

2. The sanitary washing device according to claim 1, wherein the human-body washing nozzle is movable back and forth and jets a liquid to a local region of a human body, wherein the scattering suppression member moves between the closed position and the opened position in conjunction with forward and backward movements of the human-body washing nozzle.

3. The sanitary washing device according to claim 2, wherein the scattering suppression member covers a tip end portion of the human-body washing nozzle at the closed position.

4. The sanitary washing device according to claim 3, further comprising:

a motion conversion mechanism that converts a linear motion of the human-body washing nozzle into a rotational motion of the scattering suppression member.

5. The sanitary washing device according to claim 4, wherein the human-body washing nozzle includes a nozzle body having a liquid jetting port and the cylinder portion that accommodates the nozzle body therein, the nozzle body is movable back and forth relative to the cylinder portion, the cylinder portion is movable back and forth relative to the casing, and the motion conversion mechanism converts a linear motion of the cylinder portion into a rotational motion of the scattering suppression member.

6. The sanitary washing device according to claim 5, wherein the motion conversion mechanism is a link mechanism having one end connected to the scattering suppression member, and the link mechanism includes a slider provided on the other end side thereof, the slider being guided by the casing and pressed by the cylinder portion.

7. The sanitary washing device according to claim 5, wherein the motion conversion mechanism includes:

the connection member, a curved portion formed between the one end portion and the other end portion, and a pressed portion provided on the curved portion; and the rotating member that presses the pressed portion of the connection member so as to allow the connection member to rotate relative to the casing.

8. The sanitary washing device according to claim 2, further comprising:

a motion conversion mechanism that converts a linear motion of the human-body washing nozzle into a rotational motion of the scattering suppression member.

9. The sanitary washing device according to claim 8, wherein the human-body washing nozzle includes a nozzle body having a liquid jetting port and the cylinder portion that accommodates the nozzle body therein, the nozzle body is movable back and forth relative to the cylinder portion, the cylinder portion is movable back and forth relative to the casing, and the motion conversion mechanism converts a linear motion of the cylinder portion into a rotational motion of the scattering suppression member.

10. The sanitary washing device according to claim 9, wherein the motion conversion mechanism is a link mechanism having one end connected to the scattering suppression member, and the link mechanism includes a slider provided on the other end side thereof, the slider being guided by the casing and pressed by the cylinder portion.

11. The sanitary washing device according to claim 9, wherein the motion conversion mechanism includes:

the connection member, a curved portion formed between the one end portion and the other end portion, and a pressed portion provided on the curved portion; and the rotating member that presses the pressed portion of the connection member so as to allow the connection member to rotate relative to the casing.

* * * * *